US005251817A

United States Patent [19]

Ursic

[11] Patent Number: 5,251,817

[45] Date of Patent: Oct. 12, 1993

[54] ORIFICE ASSEMBLY AND METHOD PROVIDING HIGHLY COHESIVE FLUID JET

[76] Inventor: Thomas A. Ursic, 12 Bedford Dr., West Trenton, N.J. 08628

[21] Appl. No.: 760,871

[22] Filed: Sep. 16, 1991

[51] Int. Cl.[5] ..... B05B 1/02

[52] U.S. Cl. ..... 239/11; 239/596

[58] Field of Search ..... 239/589, 590, 596, 600, 239/11, 1, 601; 299/17; 175/424

[56] References Cited

U.S. PATENT DOCUMENTS

| | | | |
|---|---|---|---|
| 2,258,001 | 10/1941 | Chamberlain | 255/1 |
| 3,386,521 | 6/1968 | Chadderdon et al. | 175/269 |
| 3,419,220 | 12/1968 | Goodwin et al. | 239/591 |
| 3,469,642 | 9/1969 | Goodwin et al. | 175/393 |
| 3,688,853 | 9/1972 | Maurer et al. | 175/422 |
| 3,705,693 | 12/1972 | Franz | 239/DIG. 4 |
| 3,750,961 | 8/1973 | Franz | 239/596 |
| 3,756,106 | 9/1973 | Chadwick et al. | 83/177 |
| 3,924,805 | 12/1975 | Nebeker et al. | 239/1 |
| 3,960,407 | 6/1976 | Noren | 299/17 |
| 3,997,111 | 12/1976 | Thomas et al. | 239/596 |
| 4,047,580 | 9/1977 | Yahiro et al. | 175/67 |
| 4,131,236 | 12/1978 | Saunders | 239/589 |
| 4,150,794 | 4/1979 | Higgins | 239/596 |
| 4,221,271 | 9/1980 | Barker | 175/422 |
| 4,244,521 | 1/1981 | Guse | 175/424 |
| 4,313,570 | 2/1982 | Olsen | 239/583 |
| 4,369.850 | 1/1983 | Barker | 175/393 |
| 4,392,534 | 7/1983 | Miida | 175/340 |
| 4,567,954 | 2/1986 | Voight et al. | 175/424 |
| 4,852,800 | 8/1989 | Murdock | 239/1 |
| 4,872,615 | 10/1989 | Myers | 239/600 |
| 4,936,512 | 6/1990 | Tremoulet, Jr. | 239/600 |
| 5,018,670 | 5/1991 | Chalmers | 239/600 |

FOREIGN PATENT DOCUMENTS

| | | | |
|---|---|---|---|
| 2903733 | 8/1980 | Fed. Rep. of Germany | 239/600 |
| 838348 | 3/1939 | France | 239/589 |
| 0686772 | 9/1979 | U.S.S.R. | 239/596 |
| 1199271 | 12/1985 | U.S.S.R. | 239/596 |

*Primary Examiner*—Andres Kashnikow
*Assistant Examiner*—Christopher G. Trainor
*Attorney, Agent, or Firm*—Ostrolenk, Faber, Gerb & Soffen

[57] ABSTRACT

Apparatus for receiving a fluid under pressure and providing a highly cohesive fluid jet stream. The apparatus has a housing for fastening to a supply tube supplying fluid under pressure to the housing. A passageway is provided in the housing through which the fluid flows, the passageway having an orifice therein for producing the fluid jet. The passageway in the housing further has a converging section disposed upstream of the orifice for reducing turbulence in the passageway upstream of the orifice, thereby providing a more cohesive fluid jet downstream of the orifice. The converging section is disposed in the housing, with the housing being a separate part from the supply tube attachable to the supply tube as a single screw-on assembly.

23 Claims, 4 Drawing Sheets

ORIFICE ASSEMBLY AND METHOD PROVIDING HIGHLY COHESIVE FLUID JET

BACKGROUND OF THE INVENTION

The present invention relates to a method and apparatus for providing high pressure fluid jet streams and, in particular, the invention relates to an orifice assembly for providing a highly cohesive fluid jet, e.g. a waterjet. Such fluid or water jets are now used for cutting of various materials, including hard materials such as stone and concrete, and softer materials such as, for example, plastics and leather.

In the past, a problem with devices producing high pressure fluid jets is that the cohesiveness of the jet, i.e., the convergence of the velocity vectors of the fluid making up the fluid jet, only extends for a relatively short distance. Being able to create a more cohesive or convergent fluid jet allows for finer fluid jet streams and, accordingly, more precise cutting, as well as the ability to allow the fluid jet nozzle to be disposed at a greater distance from the object being cut or to cut more deeply. This is particularly important in the robotics area, for example, where a fluid jet must closely follow the contour of the object being cut because of the small distance over which the fluid jet is cohesive. At greater distances from the object, the fluid jet becomes more turbulent, providing a wider kerf or width of cut, and, if too turbulent, thereby reducing the precision of the cut, or reducing the ability to cut the material at all. It has been observed that a reason for the lack of cohesiveness of a cutting jet is the presence of turbulence upstream of the orifice through which the cutting jet emerges. In addition to the above problems, the presence of turbulence may result in undesirable wetting of the material being cut.

Several devices have been proposed in the past for solving this problem. One is disclosed in U.S. Pat. No. 3,997,111, in which a lengthy liquid collimating device is disposed upstream of the nozzle orifice and wherein the flow collimating chamber is at least one hundred times greater than the cross-sectional area of the nozzle opening.

In another proposal, U.S. Pat. No. 4,852,800, a convergent section is disposed upstream of the orifice to reduce the turbulence upstream of the orifice and thereby provide a more convergent fluid jet downstream of the orifice.

Although the above devices help to provide a more cohesive fluid jet from the fluid jet orifice, they suffer from a number of disadvantages. The collimating chamber of the '111 patent is disadvantageous for its size and weight. The device of the '800 patent requires modifications to be made to the collimating chamber of the nozzle or fluid supply tube by the provision of a conical section upstream of the orifice.

In one commercially-available fluid jet producing device, the supply tube to the fluid jet producing orifice is approximately 3/16 inch. In another commercial design, the supply tube is approximately ¼ inch. The larger, ¼ inch supply tube provides less turbulence to the nozzle orifice than the 3/16 inch supply tube. The larger supply tube, therefore, provides a more cohesive fluid jet from the orifice than those devices provided with the smaller diameter supply tube.

SUMMARY OF THE INVENTION

It is, accordingly, an object of the present invention to provide an orifice assembly for providing a highly cohesive fluid jet.

It is yet still a further object of the present invention to provide such an orifice assembly for generating a highly cohesive fluid jet which can be conveniently and easily attached to conventional high pressure fluid supply tubes, without any modifications being made to the tube other than the attachment of the orifice assembly to the supply tube in place of the conventional orifice assembly.

It is yet still a further object of the present invention to provide such an orifice assembly for generating a highly cohesive fluid jet which allows those devices having smaller diameter supply tubes, e.g., the 3/16 inch supply tube, to be retrofitted by the device of the invention, thereby allowing these devices to provide more cohesive fluid jets.

It is still another object of the invention to provide an orifice assembly wherein the orifice element is disposed in the screw-on housing fastened to the end of the fluid supply tube.

The above and other objects of the present invention are achieved by an apparatus for receiving a fluid under pressure and providing a highly cohesive fluid jet stream therefrom, comprising a housing for fastening to a supply tube supplying fluid under pressure to the housing, the housing having a passageway therein through which the fluid flows, the passageway having an orifice therein for producing the fluid jet, the passageway further having a converging section disposed upstream of the orifice for reducing turbulence in the passageway upstream of the orifice, thereby providing a more cohesive fluid jet downstream of the orifice, the converging section being disposed in the housing receiving the orifice, the housing being a separate part from the supply tube.

According to another aspect, the invention provides an apparatus for attaching to a fluid supply tube having a substantially constant internal diameter and for receiving a fluid from the supply tube under pressure and providing a highly cohesive fluid jet stream therefrom, comprising a housing for fastening to a supply tube supplying fluid under pressure to the housing, the housing having a passageway therein through which the fluid flows, the passageway having an orifice therein for producing the fluid jet, the passageway further having a converging section disposed upstream of the orifice for reducing turbulence in the passageway upstream of the orifice, thereby providing a more cohesive fluid jet downstream of the orifice, said converging section being disposed in the housing as an integral part of the housing receiving the orifice, said housing being a separate part from said supply tube and retaining the orifice in position in the passageway.

According to yet still another aspect, the invention provides a method for producing a highly cohesive fluid jet comprising receiving fluid under pressure through a supply tube, providing a housing at the end of the supply tube having a passageway with an orifice in the passageway, providing a converging section in the passageway in the housing containing the orifice upstream of the orifice for reducing turbulence in the fluid near the orifice, thereby providing a more cohesive fluid jet downstream of the orifice.

Other features and advantages of the present invention will become apparent from the following detailed description of the invention.

BRIEF DESCRIPTION OF THE DRAWINGS

The invention will now be described in greater detail in the following detailed description with reference to the drawings in which.

DETAILED DESCRIPTION OF THE DRAWINGS

Figure 1:
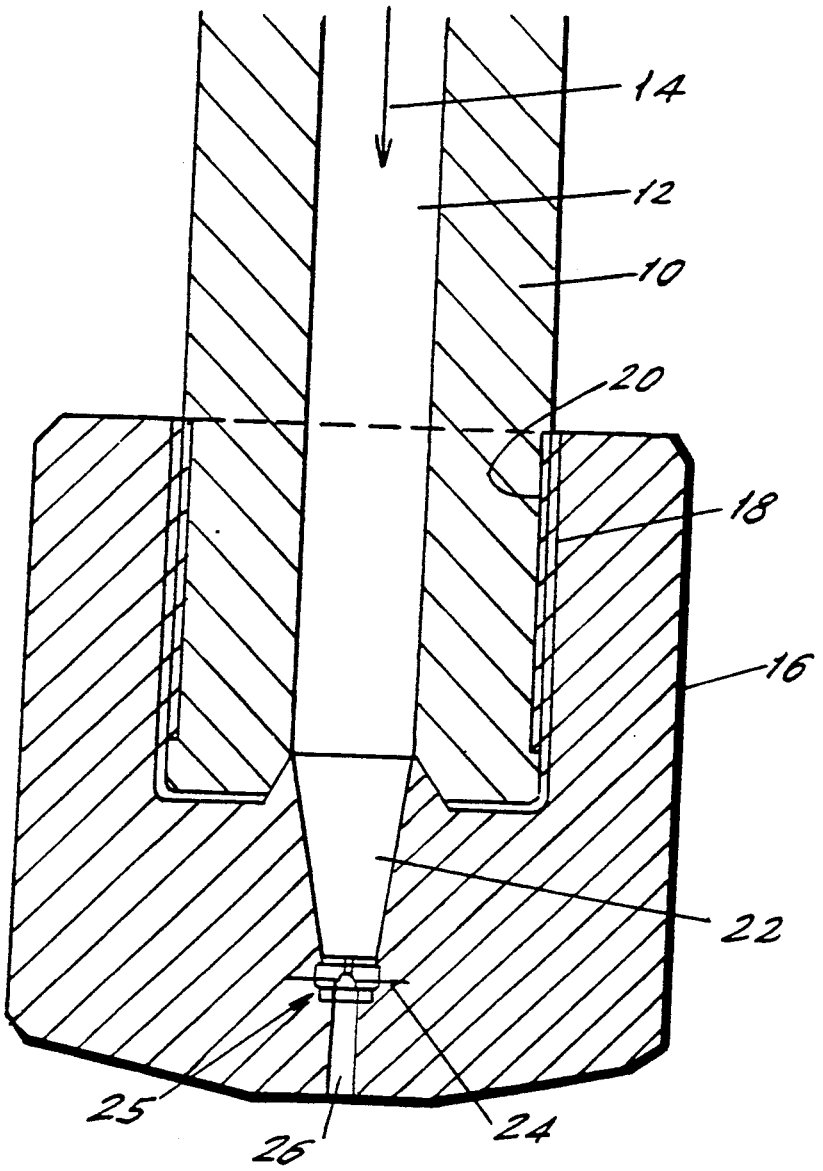
FIG. 1 is a cross section through the high cohesiveness orifice assembly according to the present invention.

With reference now to the drawings, the high cohesiveness orifice assembly according to the present invention is shown in FIG. 1. The conventional fluid supply tube is depicted at 10, and the supply tube bore for providing high pressure fluid to the orifice is shown at 12. The direction of fluid flow is indicated by the arrow 14.

An orifice housing 16 is provided which has internal threads 18 in a cavity 17 engaging external threads 20 provided on the supply tube. The orifice housing 16 may be made of metal and includes a converging section 22 opening into cavity 17 receiving supply tube 10, the converging section 22 preferably having a conical taper having its smaller diameter terminating at an orifice 24. Orifice 24 typically may be a sapphire jewel, for its extreme hardness and ability to withstand the tremendous pressures from the fluid, which may be greater than 50,000 psi. The orifice preferably is disposed on an orifice support 25, which may be a flexible protective support as disclosed in applicant's copending application Ser. No. 1824-3, filed concurrently herewith. Downstream of the orifice 24, a nozzle opening 26 is provided through which the fluid stream is emitted.

Figure 2:
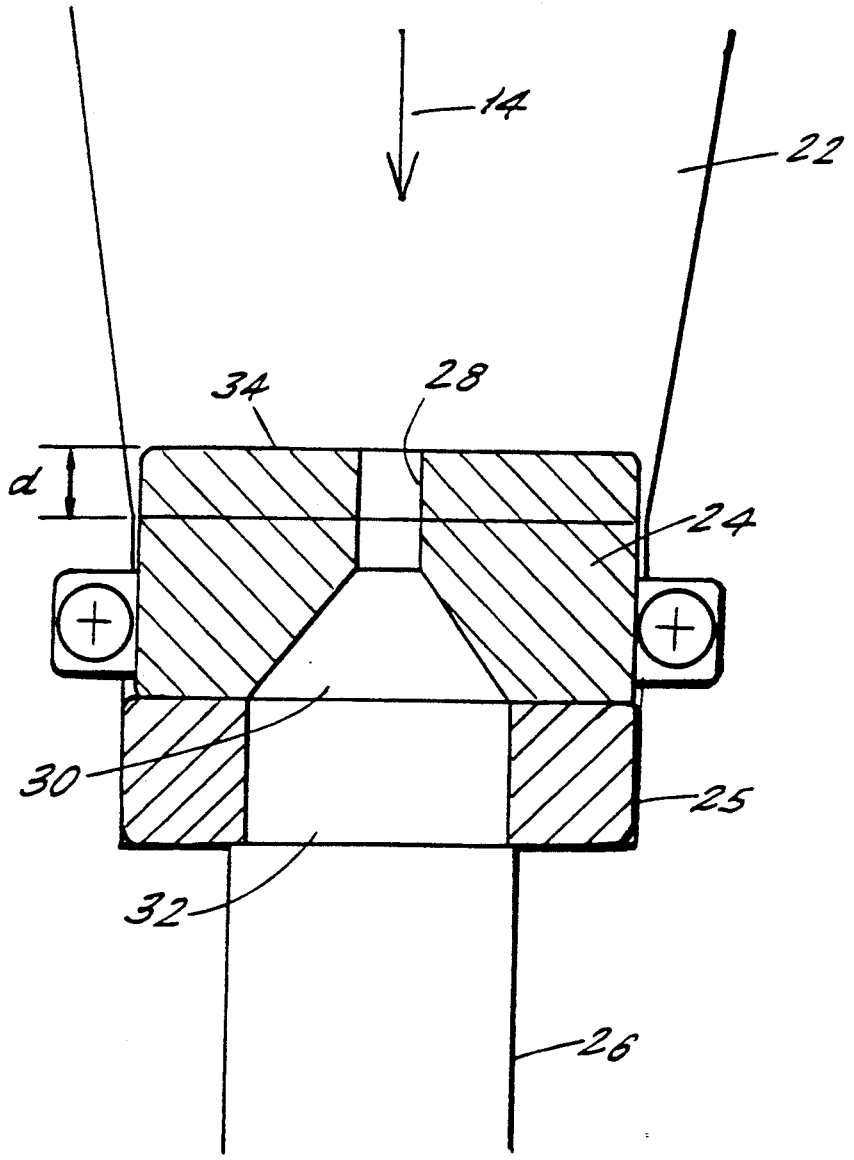
FIG. 2 is a detail of the cross section of the high cohesiveness orifice assembly according to the present invention.

As shown in FIG. 2, the orifice 24 is typically provided with a cross-section having an initial straight section 28, followed by a diverging section 30. An additional straight section 32 of the support 25 has a diameter greater than section 28 and equal to the larger diameter of the diverging section 30.

In accordance with an aspect of the invention, it has been found preferable to dispose the surface 34 of the orifice 24 a small distance d into the converging section 22. The reason for this will be explained in greater detail below.

Figure 3:
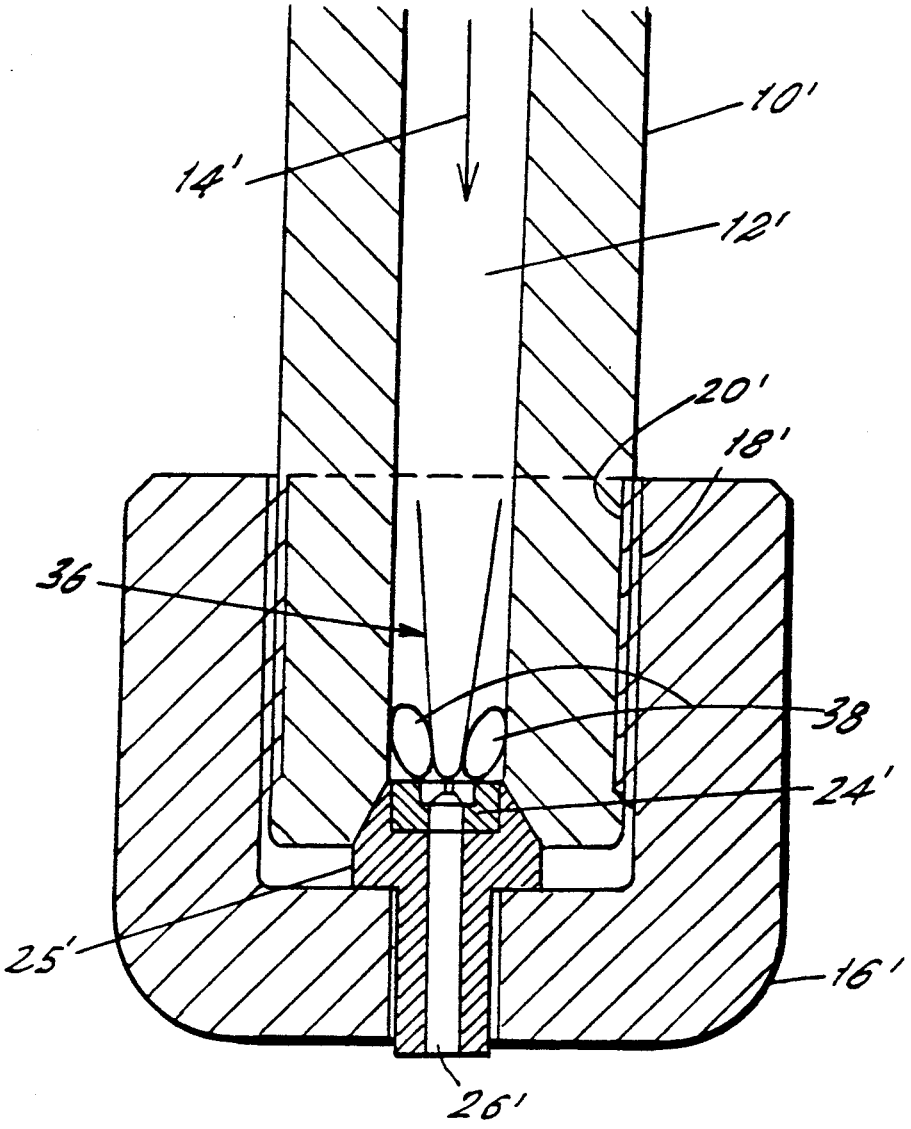
FIG. 3. (PRIOR ART)
FIG. 3 is a cross section through a prior art fluid jet orifice mounting configuration showing the fluid velocity profile and turbulent eddy currents generated in the fluid supply tube by the square end surface of the orifice and the rapidly moving fluid through the orifice.
Figure 4:
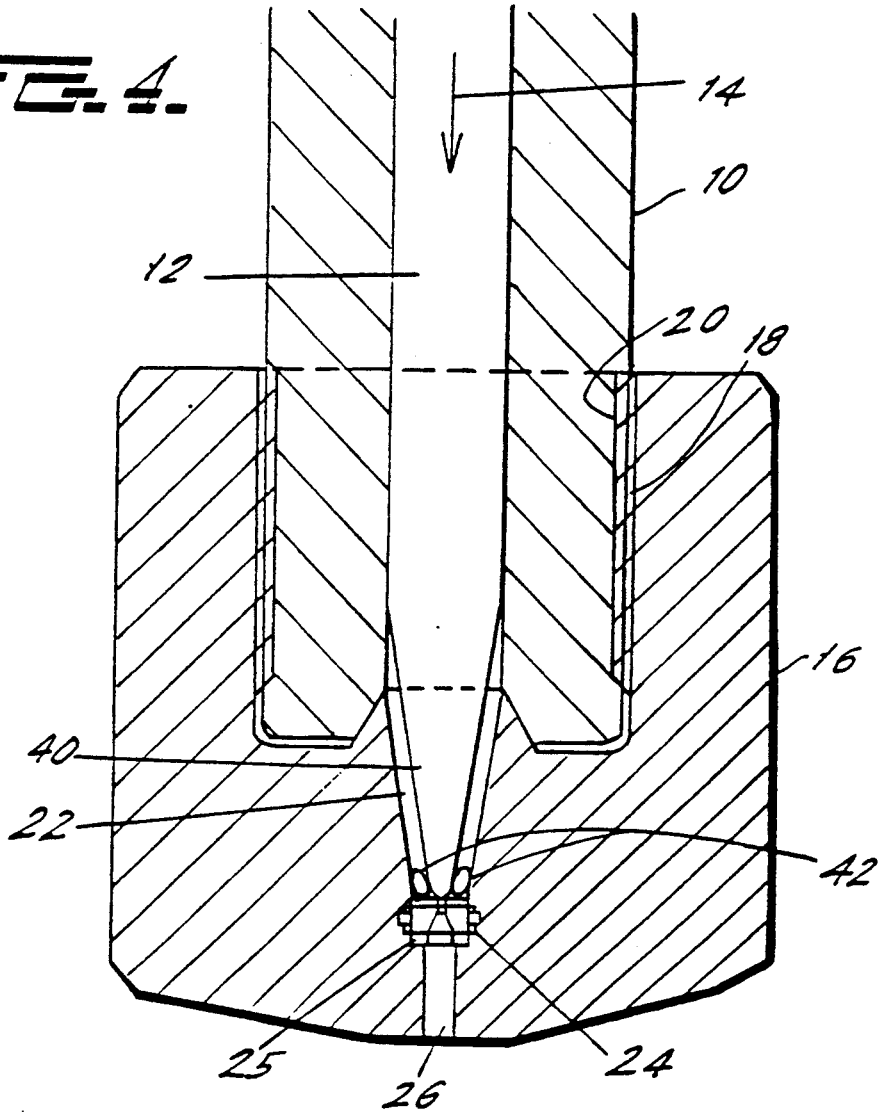
FIG. 4 is a cross section through the high cohesiveness orifice assembly according to the present invention showing the fluid velocity profile and smaller eddy currents induced in the device according to the present invention.

FIGS. 3 and 4 will be used to explain why the present invention provides advantages over the prior art devices wherein the fluid is supplied to the orifice through a substantially straight supply tube. As discussed above, it is already known that a converging section may be provided ahead of the orifice, as shown in U.S. Pat. No. 4,852,800. However, this reference requires modifications to be made to the supply tube in that a collimating cone must be provided in the supply tube itself or a special section including the converging section be disposed ahead of the orifice assembly. The present invention eliminates the need to modify the supply tube or provide a special assembly ahead of the orifice assembly, and, instead, a user simply screws the orifice assembly of the present invention onto a conventional straight supply tube (replacing the conventional orifice assembly) to achieve the effects provided by a converging section upstream of the orifice.

As shown in FIG. 3, in the conventional supply tubes 10' having a constant internal diameter, the velocity profile of the high pressure fluid flow 14, near the orifice 24' is as shown by reference numeral 36. Because of the substantially square end configuration provided by the orifice 24' at the end of the supply tube bore 12', eddy currents, shown by the ovals at 38, are generated. This means that the flow near the upstream orifice surface is turbulent, and this reduces the cohesiveness or extent of cohesiveness of the fluid jet provided at the outlet of the nozzle 26'. In FIG. 3, orifice 24' is shown supported by a fixed support 25' in a housing 16'. Housing 16' screws into supply tube 10', by way of mating screw threads 18' and 20'.

In the high cohesiveness orifice assembly according to the present invention, as shown in FIG. 4, the converging section 22 approximates the velocity profile 40 of the high pressure fluid. Because of the smaller end section of the converging section 22, which is approximately the diameter of the orifice jewel 24, less turbulence, shown by smaller eddy currents 42, is created. This reduction in the turbulence upstream of the orifice 24 allows for a more cohesive fluid jet to emerge from the nozzle 26.

It has also been found that, by disposing the upstream surface 34 of the orifice assembly 24 into the converging section 22 by a small distance d, as shown in FIG. 2, the cohesiveness of the fluid jet is not impaired and possibly may be improved. The small distance d may be approximately 0.008 inch, but less than 0.015 inch. This is thought to be due to the fact that the orifice upstream surface 34 protrudes into the region of laminar flow of the fluid, which thereby reduces the turbulence of the fluid entering the orifice and increases the cohesiveness of the fluid jet emerging therefrom. If the surface 34 protrudes too far into the converging section 22, however, the cohesiveness is impaired.

Referring to FIG. 4, another advantage provided by the present invention is that the orifice is located closer to the end of the housing 16 than in the prior art arrangement shown in FIG. 3. This allows the orifice to be disposed closer to the work, thereby providing a longer, more cohesive fluid jet to the work. For example, in the device shown in FIG. 4, the downstream surface of orifice 24 is approximately $\frac{1}{8}$ inch from the end of the nozzle housing. In the device of FIG. 3, the same distance is about $\frac{3}{8}$ inch, resulting in a less cohesive fluid jet applied to the work.

The present invention provides significant advantages over the prior art device shown in FIG. 3, as well as the devices shown in the '800 and '111 patents. In particular, the present invention provides an orifice assembly which fastens directly to the end of a conventional supply tube with a single screw-on assembly. The use of the invention requires no modifications to be made to the conventional constant internal diameter supply tubes currently in use and does not require that a special assembly be mounted ahead of the orifice. Instead, a user simply mounts the single assembly of the invention to the conventional supply tube.

The present invention thus provides advantages over the device of the '800 patent, as it does not require modification of the supply tube and can be installed on conventional constant internal diameter supply tubes and, in particular, the smaller 3/16 inch diameter supply tubes currently in use, to give these devices employing the smaller supply tubes the advantages provided by the larger diameter supply tubes.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification is, accordingly, to be regarded in an illustrative rather than a restrictive sense.

I claim:

1. Apparatus for receiving a fluid under pressure and providing a highly cohesive fluid jet stream therefrom, comprising:

a housing for fastening to a supply tube supplying fluid under pressure to the housing the housing having a passageway therein through which the fluid flows, the passageway having an orifice therein formed by an opening in an orifice element for producing the fluid jet stream, the orifice element having an upstream surface, the passageway further having a converging section disposed upstream of the orifice for reducing turbulence in the passageway upstream of the orifice, the converging section extending to the upstream surface of the orifice element, thereby providing a more cohesive fluid jet downstream of the orifice, said converging section being disposed in the housing receiving the orifice, said housing being a separate part from said supply tube, said upstream surface of said orifice element extending into said converging section.

2. The apparatus recited in claim 1, wherein said supply tube has a diameter and further wherein said converging section comprises a conical section tapering from a first diameter substantially the same as the diameter of said supply tube to a second smaller diameter.

3. The apparatus recited in claim 2, wherein the orifice element has an external diameter, said second diameter being approximately the same as said external diameter.

4. The apparatus recited in claim 3, wherein said housing has a cavity therein leading into said converging section, said cavity having internal threads for fastening to external threads provided on said supply tube.

5. The apparatus recited in claim 1, wherein said orifice element extends into said converging section at most 0.015 inch.

6. The apparatus recited in claim 1, further comprising an exit nozzle passage provided downstream of said orifice through which said fluid jet stream emerges.

7. Apparatus for receiving a fluid under pressure and providing a highly cohesive fluid jet stream therefrom, comprising:

a housing for fastening to a supply tube supplying fluid under pressure to the housing;

the housing having a passageway therein through which the fluid flows, the passageway having an orifice therein formed by an opening in an orifice element for producing the fluid jet stream, the orifice element having an upstream surface, the passageway further having a converging section disposed upstream of the orifice for reducing turbulence in the passageway upstream of the orifice, the converging section extending to the upstream surface of the orifice element, thereby providing a more cohesive fluid jet downstream of the orifice, said converging section being disposed in the housing as an integral part of said housing, said housing being a separate part from said supply tube and retaining said orifice element in position in said passageway, said upstream surface of said orifice element extending into said converging section.

8. The apparatus recited in claim 7, wherein said supply tube has a diameter and further wherein said converging section comprises a conical section tapering from a first diameter substantially the same as the diameter of said supply tube to a second smaller diameter.

9. The apparatus recited in claim 8, wherein the orifice element has an external diameter, said second diameter being approximately the same as said external diameter.

10. The apparatus recited in claim 9, wherein said housing has a cavity therein leading into said converging section, said cavity having internal threads for fastening to external threads provided on said supply tube.

11. The apparatus recited in claim 7, wherein said orifice element extends into said converging section at most 0.15 inch.

12. The apparatus recited in claim 11, further comprising an exit nozzle passage provided downstream of said orifice through which said fluid jet stream emerges.

13. A method for producing a highly cohesive fluid jet comprising:

receiving fluid under pressure through a supply tube;

providing a housing at the end of the supply tube having a passageway with an orifice formed by an opening in an orifice element in the passageway, the orifice element having an upstream surface;

providing a converging section in the passageway in the housing containing the orifice upstream of the orifice for reducing turbulence in the fluid near the orifice, the converging section extending to the upstream surface of the orifice element, thereby providing a more cohesive fluid jet downstream of the orifice, and extending said upstream surface of the orifice element into said converging section.

14. The method recited in claim 13, wherein the step of providing a converging section comprises providing a converging section having a conical shape in the passageway tapering from a first diameter approximately the same as the diameter of the supply tube to a second diameter less than the first diameter.

15. The method recited in claim 14, wherein the orifice element has an external diameter, and further comprising providing said second diameter approximately equal to said external diameter.

16. The method recited in claim 13, wherein said step of extending comprises extending said upstream surface of said orifice element into said converging section at most 0.015 inch.

17. Apparatus for attaching to a fluid supply tube having a substantially constant internal diameter and for receiving a fluid from the supply tube under pressure and providing a highly cohesive fluid jet stream therefrom, comprising:

a housing for fastening to a supply tube supplying fluid under pressure to the housing;

the housing having a passageway therein through which the fluid flows, the passageway having an orifice therein formed by an opening in an orifice element for producing the fluid jet stream, the orifice element having an upstream surface, the passageway further having a converging section disposed upstream of the orifice for reducing turbulence in the passageway upstream of the orifice, the converging section extending to the upstream surface of the orifice element, thereby providing a more cohesive fluid jet downstream of the orifice, said converging section being disposed in the housing receiving the orifice, said housing being a separate part from said supply tube, said upstream surface of the orifice element extending into said converging section.

18. The apparatus recited in claim 17, wherein said supply tube has a diameter and further wherein said converging section comprises a conical section tapering from a first diameter substantially the same as the diameter of said supply tube to a second smaller diameter.

19. The apparatus recited in claim 18, wherein the orifice element has an external diameter, said second diameter being approximately the same as said external diameter.

20. The apparatus recited in claim 19, wherein said housing has a cavity therein leading into said converging section, said cavity having internal threads for fastening to external threads provided on said supply tube.

21. The apparatus recited in claim 17, wherein said orifice element extends into said converging section at most 0.015 inch.

22. The apparatus recited in claim 17, further comprising an exit nozzle passage provided downstream of said orifice through which said fluid jet stream emerges.

23. The apparatus recited in claim 19, wherein said orifice element is supported by a separate support element disposed in said housing downstream of said orifice element.

* * * * *